US005537304A

United States Patent [19]

Klaus

[11] Patent Number: 5,537,304

[45] Date of Patent: Jul. 16, 1996

[54] LIGHTING FIXTURE CANOPY

[75] Inventor: Dale A. Klaus, St. Louis County, Mo.

[73] Assignee: DAL Partnership, St. Louis, Mo.

[21] Appl. No.: 337,059

[22] Filed: Nov. 10, 1994

[51] Int. Cl.[6] ..... F21V 29/00

[52] U.S. Cl. ..... 362/373; 362/147; 362/294; 362/362; 362/367

[58] Field of Search ..... 362/294, 362, 362/367, 147, 149, 368, 370, 373, 455, 404

[56] References Cited

U.S. PATENT DOCUMENTS

| | | | |
|---|---|---|---|
| 2,638,531 | 8/1949 | Levy . | |
| 2,918,569 | 3/1957 | McCormack . | |
| 4,044,246 | 8/1977 | Docimo et al. . | |
| 4,104,713 | 8/1978 | Chan et al. | 362/373 |
| 4,234,916 | 11/1980 | Goralnik . | |
| 4,302,798 | 11/1981 | Sit | 362/368 |
| 4,356,540 | 10/1982 | Goralnik . | |
| 4,514,792 | 4/1985 | Klaus | 362/294 |

*Primary Examiner*—Denise L. Gromada
*Assistant Examiner*—Y. Quach
*Attorney, Agent, or Firm*—Polster, Lieder, Woodruff & Lucchesi

[57] ABSTRACT

A flush mounted ceiling fixture canopy molded of a polycarbonate (or other suitable) resin attachable to a conventional electric connection box in the ceiling. The canopy has a peripheral frame and a canopy body positioned centrally in the frame. The canopy body has a depending wall defining an insulating air space. There is an insulative layer below the canopy. Light bulbs are positioned below the insulative layer and, in part, below the air space to insulate the connection box from heat transfer from the bulbs. The canopy is structured so as to minimize the transfer of heat from the bulbs to the canopy structure.

11 Claims, 4 Drawing Sheets

LIGHTING FIXTURE CANOPY

BACKGROUND OF THE INVENTION

This invention relates generally to lighting fixtures, more particularly to a polycarbonate, flush-mounted ceiling fixture canopy that is designed to retard heat transfer from the light source to the ceiling and electrical connection box.

Prior art flush-mounted ceiling fixture canopies are generally adapted to be mounted on a ceiling by attachment to an electrical connection box in the ceiling. Such fixtures generally have a pan with a light socket depending therefrom. An incandescent light bulb is screwed into the light socket. A cross bar is attached to the connection box and the pan is attached to cross bar.

However, with such incandescent bulbs, excessive heat may be transferred to the light fixture canopy and/or to the ceiling or the electrical connection box. In order to meet various building and electrical codes and to obtain Underwriters Laboratories (UL) approval for the lighting fixture, the rate of heat transfer from the incandescent light bulbs to the light fixture and to ceiling or connection box should be below an acceptable level so as to reduce the risk of damage to the lighting fixture. This is particularly important if it is molded of plastic.

It would be advantageous, therefore, to provide a flush-mounted ceiling fixture that is constructed from heat resistant material employing sufficient insulation as well as heat dissipating structure between the heat generating light bulbs and the ceiling and connection box to adequately reduce the transfer of heat from the bulbs to the associated structures.

SUMMARY OF THE INVENTION

It is, therefore, among the principal objects of the present invention to provide a flush-mounted ceiling fixture canopy constructed to retard heat transfer from the fixture to the ceiling.

Another object of the invention is to provide a flush-mounted ceiling fixture canopy directly abutting the ceiling and electrical connection box, with the canopy being positioned above the light bulbs and constructed so as to create an air space between the canopy and the light bulbs to reduce heat transfer from the bulb to the ceiling and electrical connection box.

Yet another object of the invention is provide a flush-mounted ceiling fixture canopy that has an insulating layer between the air space and the light bulbs to further retard heat transfer to the ceiling and connecting box.

Still another object of the invention is to provide a flush-mounted ceiling fixture canopy wherein the elements are constructed of a polycarbonate material resistant to flames, heat, water, ice and other environmental conditions.

Another object of the present invention is to provide a flush-mounted ceiling fixture canopy in which the polycarbonate or plastic structure most subject to heat transfer from the light bulbs is minimized so as to maintain the structural integrity of the canopy.

Still another object of the present invention is to provide a flush-mounted ceiling fixture canopy that is simple and economical to mold and produce, easy to mount on a ceiling and electrical connection box, simple to maintain, resistant to environmental conditions, and well suited for its intended purposes.

In accordance with the invention, generally stated, a flush-mounted ceiling fixture canopy is provided which is preferably constructed from polycarbonate material (or other suitable synthetic resin material) attachable to an electrical connection box in a ceiling. The canopy has a peripheral frame with a canopy body positioned centrally therein. The canopy body is held in place in the frame by opposed support arms extending from the canopy body to the frame. The canopy body has a depending wall defining an insulating air space. The fixture includes a layer of insulating material below the air space. A pair of conventional light bulb sockets is suspended below the insulating layer and aligned so that conventional light bulbs inserted in the sockets are positioned below the insulating layer and at least partially under the air space, such that the polycarbonate structure immediately above the bulbs is minimized for the transfer of heat thereto from the bulbs. Heat transferred through the insulating layer dissipates in the air space. A light diffuser assembly is mounted on the underside of the canopy frame and surrounds the sockets and light bulbs.

BRIEF DESCRIPTION OF THE DRAWINGS

Corresponding reference character indicate corresponding parts throughout the several views of the drawings.

DESCRIPTION OF A PREFERRED EMBODIMENT

Figure 1:
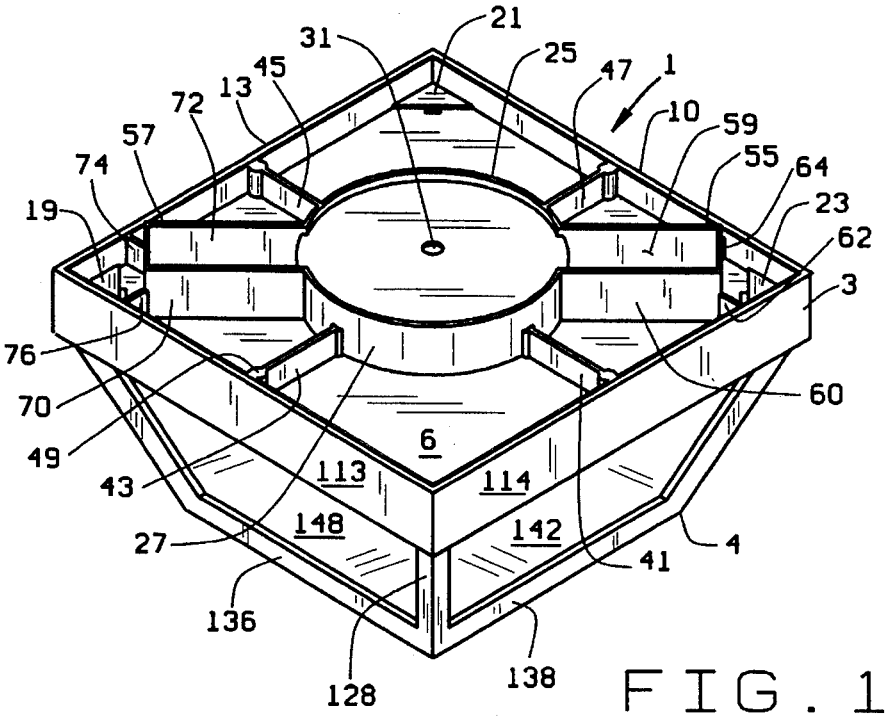
FIG. 1 is an isometric view of a lighting fixture incorporating a canopy of the present invention.
Figure 2:
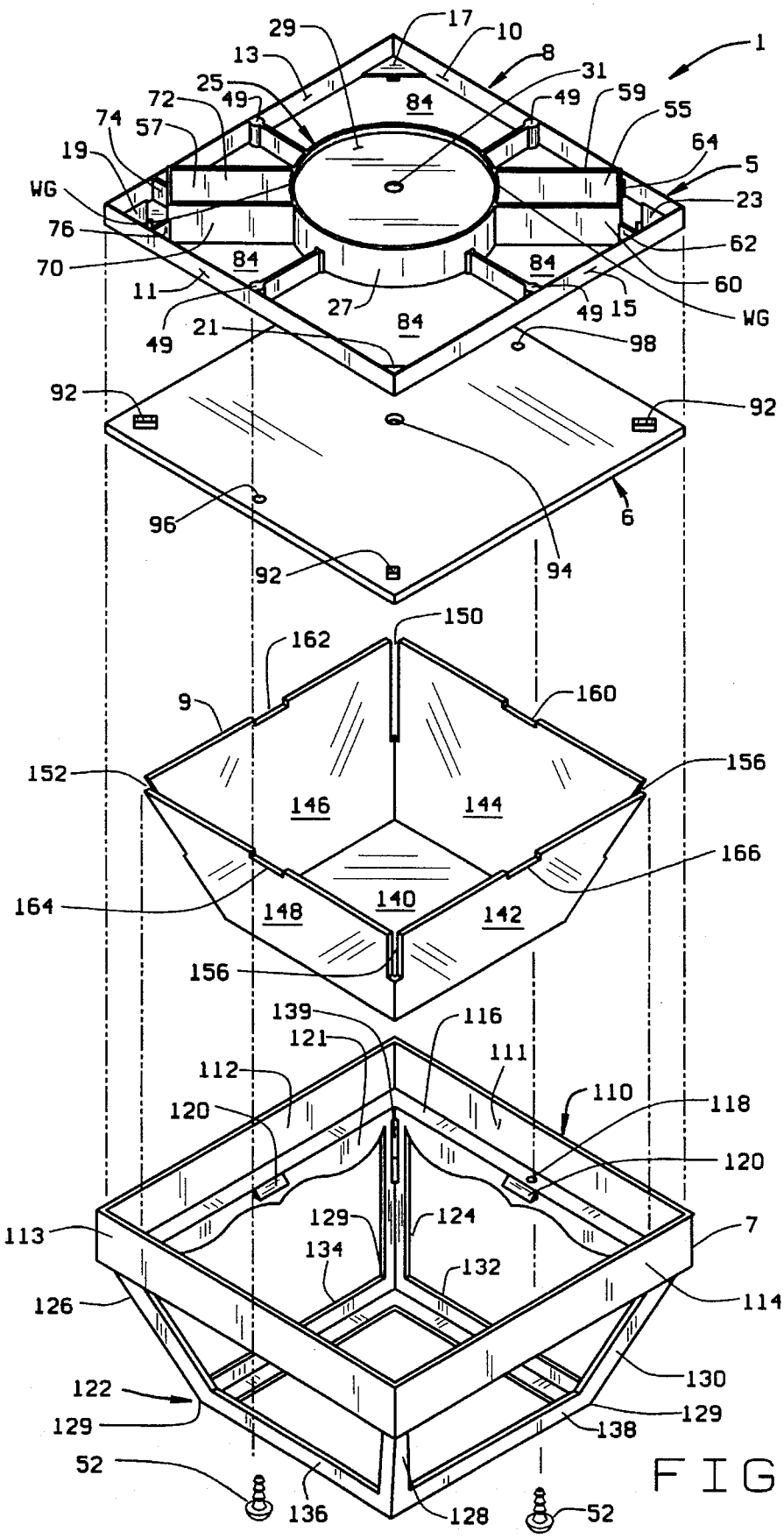
FIG. 2 is an exploded view of the lighting fixture and of the canopy of the present invention.

Referring now to the drawings, a lighting fixture is indicated generally by reference numeral 1. As illustrated in FIG. 1, lighting fixture 1 has an upper section 3 and a lower section 4. As best seen in FIG. 2, upper section 3 has a canopy 5 of the present invention and an insulative layer 6. Lower section 4 has a diffuser frame 7 and diffuser panel or lens assembly 9. The individual elements of the respective sections will now be described in greater detail.

Figure 3:
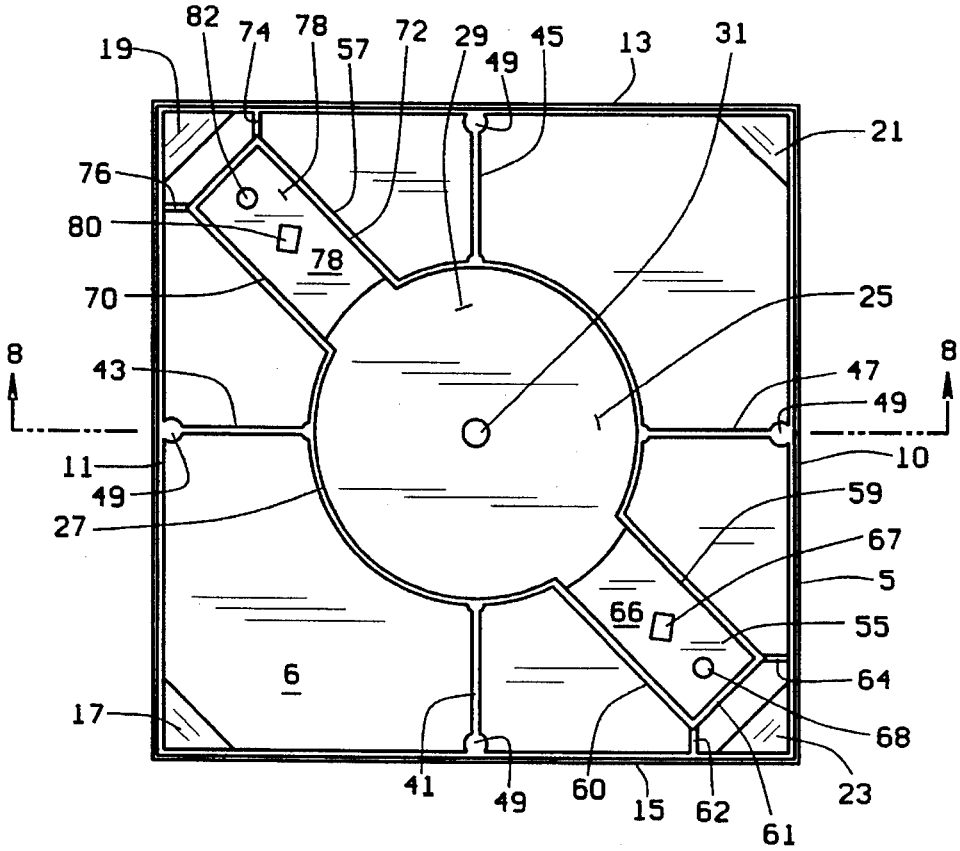
FIG. 3 is a top plan of the canopy of present invention.
Figure 4:
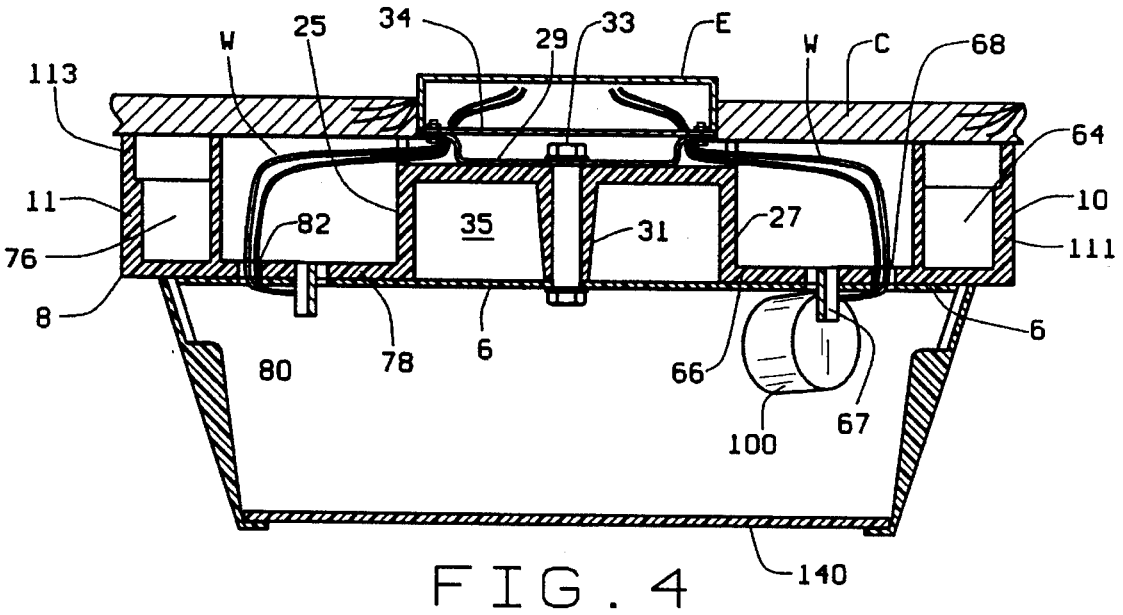
FIG. 4 is a cross-sectional view of the lighting fixture of the present invention shown mounted to a electrical connection box in a ceiling with the ceiling being shown in dotted lines.

As shown in FIG. 4, the fixture is adapted to be mounted on a ceiling C (shown in dotted lines) by attachment to a conventional electrical connection box E recessed in ceiling C and appropriately wired with conventional electric wire W. As mentioned above, upper section 3 has a canopy 5. Canopy 5, shown in greater detail in FIGS. 1–5, is constructed of a heat resistant synthetic resin material, preferably, but not necessarily, polycarbonate. The polycarbonate material is preferred because it is resistant to weather deterioration, has good impact resistance, and has high temperature capabilities. Canopy 5 has a generally rectangular, outer peripheral frame 8 with four elongated wall members 10, 11, 13 and 15. There are triangular corner braces 17, 19, 21 and 23 (as best shown in FIG. 3) appropriately positioned between the walls to add support and rigidity to the frame. Canopy 5 has an inner, centrally located canopy frame or body 25 positioned within outer peripheral frame 8. Canopy body 25 has an annular vertical wall 27 and a top wall 29. A hollow boss 31 depends from top wall 29. A length of hollow, threaded rod 33 (see FIG. 4) is received within hollow boss 31 and it has a cap nut on its lower end. The threaded rod extends upwardly through and threadably engages a threaded extrusion formed in a cross bar 34 spanning across connection box E so as to attach the fixture 1 to the connection box E.

As shown in FIG. 4, annular wall 27 and top wall 29 define an air space 35 which surrounds boss 31. Space 35 serves to insulate connection box E and top wall 29 from heat which may be transferred through insulative layer 6, as will be explained below.

The inner canopy frame or body 25 is connected to the outer peripheral frame 8 by struts 41, 43, 45 and 47, as shown in FIG. 3. The respective struts are perpendicular to the respective flat wall members. The respective struts have a boss 49 having a threaded bore, as at 50 (see FIG. 5) to accept threaded thumb screws 52 or other appropriate attachment means to attach the diffuser or lens assembly 9 to an end wall 61.

Pairs of angled wings 62, 64, and 74, 76 extend inwardly from the corners of the upper section as will be explained hereinafter.

Figure 5:
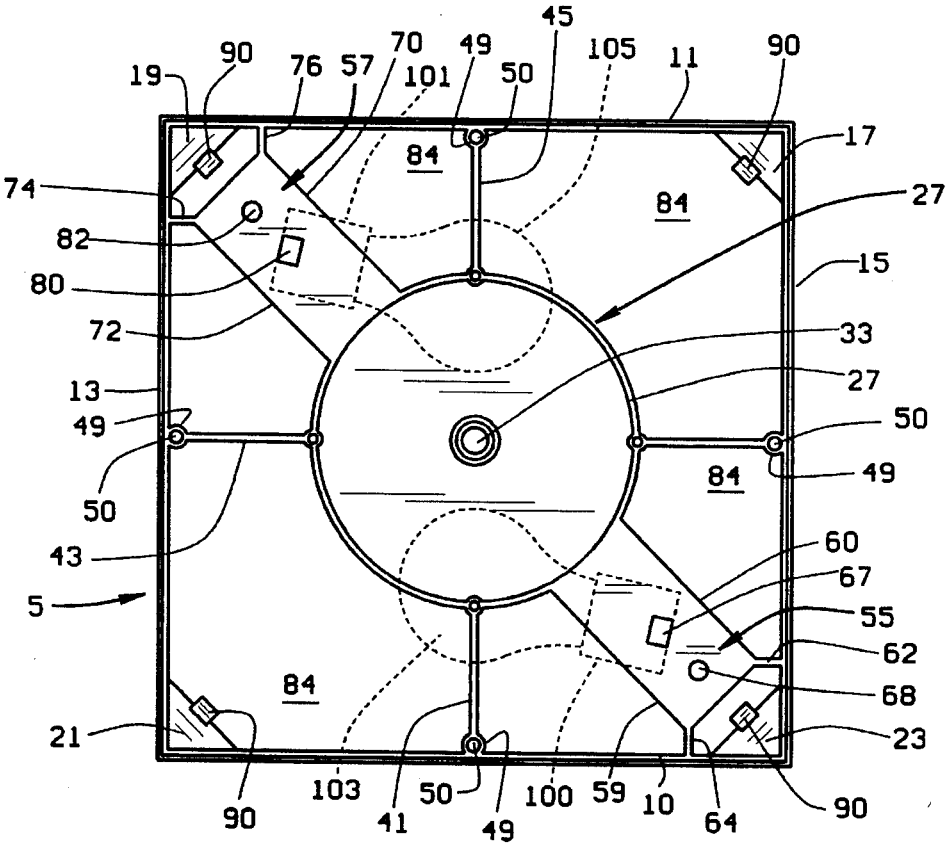
FIG. 5 is a bottom plan of the canopy of the present invention.
Figure 6:
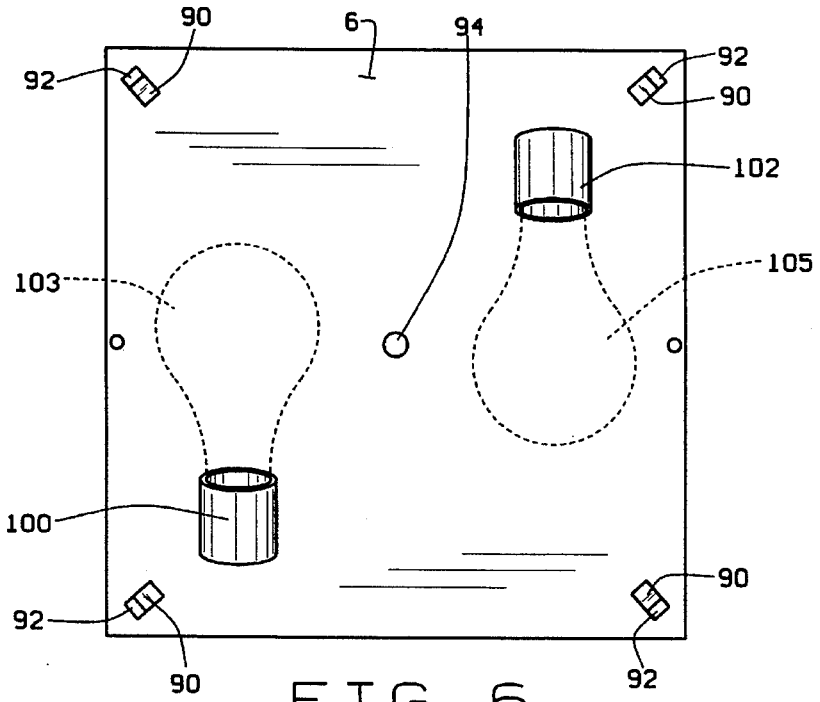
FIG. 6 is a bottom plan of the upper section of the lighting fixture.
Figure 7:
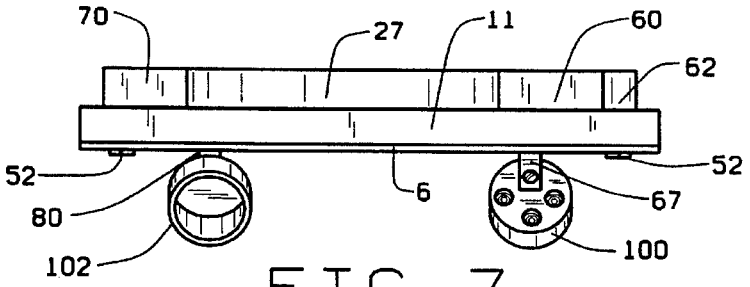
FIG. 7 is a side elevational view of the upper section of the lighting fixture of the present invention.
Figure 8:
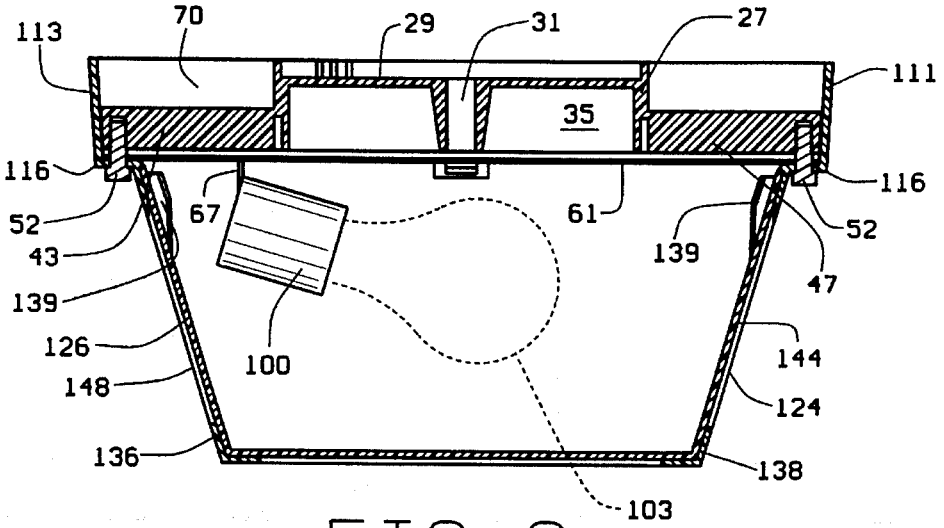
FIG. 8 is a cross-sectional view of the lighting fixture and canopy taken along lines 8—8 of FIG. 3.

Referring to FIG. 5, a pair of opposed support arms 55 and 57 extend from opposite corners of peripheral frame 8 to canopy wall 27. Arm 55 has a pair of opposed vertical walls 59 and 60 and from the respective side walls and straddle corner brace 23. It will be noted that the portion of canopy vertical wall 27 spanning between arms 55 and 57 are provided with wire grooves WG (see FIG. 3) in the upper surface thereof so that the canopy can be flush mounted on the ceiling and so that the wires for the lamp sockets can readily be routed in the wire grooves. Arm 55 also has a lower flat horizontal wall 66. Wall 66 has socket connector opening 67 for receiving a socket connector carried by the bulb socket for the snap-in attachment of a conventional electrical socket or lampholder 100, as will appear. Wall 66 also has a wiring access hole 68 formed therein through which the wiring for the lampholder or socket can be routed. Arm 57 has a pair of opposed elongated vertical side walls 70 and 72, an end wall, and a pair of angled wings 74 and 76. Wings 74 and 76 straddle corner brace 19. Arm 57 also has a lower horizontal wall 78. Wall 78 has an electrically conductive socket connection 80 and a wiring access hole 82 formed therein.

As is apparent from FIG. 5, that canopy 5 is skeletal in design, and that there are open areas, as at 84, between the recited structural elements. In accordance with this invention, open areas 84 allow for the dissipation of any heat that transfers through the insulative layer and provides that incandescent light bulbs position below the frame are not positioned directly under any flat expanse of polycarbonate material comprising the structure of canopy 5 which may cause undue heating of the polycarbonate material.

Insulative layer 6 is dimensioned to fit within canopy frame 8. Clips 90 (see FIG. 5) is integrally attached to corner braces 17–23 to secure insulative layer 6 to the frame 8. The clips fasten through holes 92 formed in the four corners of insulative layer 6. Layer 6 is made of a suitable insulative material, such as a fiberglass batt or similar material. Preferably layer 6 would have a reflective metallic finish, for example aluminum foil, on the bottom side so as to reflect radiant energy from the light bulbs away from the insulative layers. There is a screw hole 94 formed centrally in layer 6. Screw holes 96 and 98 are formed on the opposite sides on the peripheral edge of layer 6.

FIGS. 5–8 best illustrate the arrangement in orientation of conventional incandescent light bulbs relative to the upper section 3 of the light fixture of the present invention. A first lamp holder or socket 100 is electrically connected to connection 80. A second lamp holder or socket 102 is electrically connected to connection 80. Conventional incandescent light bulbs 103 and 105 are inserted in the respective sockets. The respective bulbs are aligned side-by-side yet point in opposite directions. Light bulbs 103 and 105 are positioned below insulative layer 6. A large portion of each respective light bulb is positioned under air space 35 and the remainder of each light bulb is positioned below an open space 84. Thus, in accordance with this invention, no incandescent light bulb is directly below a flat expanse of polycarbonate material. The only polycarbonate (plastic) structure of canopy 5 directly above the location of the bulbs 103, 105 are the vertically disposed wall 27 and struts 41, 45. As shown wall 27 and struts 41, 45 are generally rectangular in cross section and this may have a minor dimension (i.e., their thickness) and a major dimension (i.e., their height). Those walls are positioned above the light bulbs 103, 105 such that only their minor dimension is closest to the light bulbs thereby to minimize the transfer of heat thereto. It will be appreciated that these vertical walls have very little area directly exposed to heat transfer from the bulbs, and that they extend vertically into open areas 84 between the upper face of insulative panel 6 and the ceiling C thereby to dissipate heat to the air. In the manner the polycarbonate vertical walls are maintained at a temperature well below a temperature in which they would become deformed by the heat transferred thereto by bulbs 103, 105.

Furthermore, air space 35 serves to insulate connection box C and hidden canopy wall 29 from any heat that produced by the bulbs that transfers through insulative layer 6.

Lower section 4 of the fixture of the present invention is best illustrated in FIG. 2. And stated above the lower section comprises the diffuser frame 7 and diffuser or lens pane assembly 9. Frame 7 has a generally rectangular upper frame 110. Upper frame 110 has four walls 111, 112, 113 and 114. The respective walls have a sufficient vertical height so as to cover the entire canopy 5 from view when the diffuser frame is mounted on the canopy frame. This causes canopy 5 to be hidden from view and enhances the appearance of flush mounting of the fixture against the ceiling. A peripheral horizontal ledge 116 extends around the interior perimeter of the frame to abut the bottom of canopy frame 8 when mounted. Screw holes 118 are formed in the ledge 116 for mounting. Bosses 120, are formed on ledge 116. An ornamental designs, as at 121 can be formed of polycarbonate material depend from ledge 116 to add to the aesthetic appeal of the fixture.

A lower diffuser frame assembly 122 consists of four angled, depending corner members 124, 126, 128 and 130. The corners, integrally connected to four angular bottom frame members 132, 134, 136 and 138 tabs as at 139 (FIG. 8), extend inwardly from the corners 129 to engage positioning grooves on the pane assembly. The respective members cooperate to form a conventional, generally box-like, frame work to seat diffuser or lens panel assembly 9.

Diffuser panel assembly 9 consists of a bottom lens pane 140 and four vertically angled side lens panes 142, 144, 146 and 148. Slots 150, 152, 154, and 156 are formed between the panes to engage the respective tabs 139. Cutouts 160, 162, 164, 166, are designed to engage bosses 120. Pane assembly 9 is constructed from a translucent material so as to allow emission of light generated by the incandescent bulbs.

Although the fixtures shown and described are generally rectangular in shape and mounted on a ceiling, it will be appreciated that other configurations, such as circular, can employ the novel heat transfer reducing elements of the present invention. Moreover, such fixtures maybe mounted on a wall or other structure.

It also will be appreciated from the description and illustration that the lighting fixture of the present invention is effective to reduce heat transfer upwardly to the polycarbonate canopy body and to the electrical connection box and ceiling. Various changes and modifications can be made in the light fixture without departing from the scope of the appended claims. Therefore the foregoing description and accompanying drawings are intended to be illustrative only and not to be viewed in a limiting sense.

What is claimed is:

1. A lighting fixture for mounting on a ceiling by attachment to an electrical connection box, said lighting fixture comprising:

a canopy extending down from said ceiling when said lighting fixture is installed thereon, said canopy having an inner canopy frame and an outer canopy frame and a plurality of support struts for supporting the outer canopy frame relative to the inner canopy frame, said canopy, said inner and outer canopy frames and said support struts being molded of synthetic resin material and defining a plurality of air spaces within said canopy;

an insulative panel associated with said canopy disposed below said canopy;

at least one socket associated with said canopy disposed below said insulative panel, said socket mounting an incandescent light bulb beneath said insulative panel;

said canopy being structured such that said inner canopy frame in the areas directly above said light bulb is devoid of webs of said synthetic material that forms said inner canopy frame; and said inner and outer canopy frames and said support struts have a major and a minor dimension and are orientated within said lighting fixture with the areas directly above said light bulb, said minor dimensions of said inner and outer canopy frames and said support struts being disposed toward said light bulb thereby to minimize the transfer of heat to said synthetic resin canopy frames and to said support struts such that said canopy frames and said support struts do not substantially distort due to heat transferred thereto by said light bulb.

2. The ceiling mounted light fixture of claim 1 further comprising a light diffuser associated with said canopy below said canopy and surrounding the light bulb.

3. The ceiling mounted light fixture of claim 1 wherein said canopy is formed from polycarbonate material.

4. A flush-mounted lighting fixture adapted to be mounted on a ceiling and connected to an electrical connection box comprising:

a canopy frame designed to surround the connection box;

a canopy body centrally located within said frame and abutting the ceiling and surrounding the connection box, said canopy body attached to said frame by at least one support arm means, said canopy body having a depending wall defining an air space, said canopy body and the connection box being hidden from view by said surrounding canopy frame when the lighting fixture is mounted on and abutting said ceiling and connected to the electrical connection box;

an insulating layer on a bottom side of said canopy body below said air space;

at least one socket for the insertion of a light source below said insulating layer and disposed to position the light source, at least partially, below said air space; and a light diffuser depending from said canopy frame and surrounding the light source.

5. The lighting fixture of claim 4 further including a second socket extending below said insulating layer and disposed to position a second light source, at least partially, below said air space.

6. The light fixture of claim 5 wherein said light sources comprise a pair of incandescent light bulbs, said sockets positioned for mounting said light bulbs in a generally side-by-side, but opposite, position.

7. The lighting fixture of claim 4 wherein said canopy frame and canopy body are constructed from polycarbonate material.

8. The lighting fixture of claim 4 wherein said light diffuser includes a plurality of panes.

9. A flush mounted ceiling light fixture for attachment to a ceiling and an electrical connection box mounted in the ceiling comprising:

a canopy disposed below said ceiling, said canopy formed of a polycarbonate material and having a generally rectangular canopy frame and a centrally located canopy body connected to said canopy frame by a first and a second support arm means, said canopy having an annular, depending wall defining an air space;

an insulating layer below said canopy body and constructed to fit within said canopy frame;

a first electrical socket attached to said first support arm means and extending below said insulating layer and disposed to position a light source mounted therein, in part, below said air space;

a second electrical socket attached to said second support arm means and extending below said insulating layer and disposed to position a light source mounted therein, in part, below said air space; and a light diffuser assembly on an underside of said canopy frame, said light diffuser assembly having a frame and a plurality of light diffusing panels mounted therein and surrounding said sockets.

10. The light fixture of claim 9 formed from a polycarbonate material so as to be resistant to environmental conditions.

11. A lighting fixture for mounting on a ceiling by attachment to an electrical connection box, said lighting fixture comprising:

a canopy extending down from said ceiling when said lighting fixture is installed thereon, said canopy having an inner canopy frame and an outer canopy flame and a plurality of support struts for supporting the outer canopy frame relative to the inner canopy frame, said canopy, said inner and outer canopy frames and said support struts being molded of synthetic resin material and defining a plurality of air spaces within said canopy;

an insulative panel associated with said canopy disposed below said canopy;

at least one socket associated with said canopy disposed below said insulative panel, said socket mounting a light source beneath said insulative panel;

a light diffuser associated with said canopy below said canopy and surrounding the light source;

said canopy being structured such that said inner canopy frame in the areas directly above said light source is devoid of webs of said synthetic material forming said inner canopy frame; and said inner and outer canopy frames and said support struts have a major and a minor dimension and are orientated within said lighting fixture with the areas directly above said light source said minor dimensions of said inner and outer canopy frames and said support struts are disposed toward said light source thereby to minimize the transfer of heat to said synthetic resin canopy frames and to said support struts such that said canopy frames and said support struts do not substantially distort due to heat transferred thereto by said light source.

* * * * *